United States Patent [19]

Arteau et al.

[11] Patent Number: 4,830,341

[45] Date of Patent: May 16, 1989

[54] ANCHOR FOR TEMPORARY SAFETY FENCE

[75] Inventors: Jean Arteau; Raymond Bertrand, both of Montreal, Canada

[73] Assignee: Institut de Recherche en Sante et en Securite du Travail du Quebec, Quebec, Canada

[21] Appl. No.: 139,921

[22] Filed: Dec. 31, 1987

[51] Int. Cl.[4] ..... E04H 17/22

[52] U.S. Cl. ..... 256/65; 52/37; 256/59; 256/DIG. 6

[58] Field of Search ..... 52/298, 698–704, 52/DIG. 11; 248/519; 256/1, 59, 65, DIG. 6; 182/113

[56] References Cited

U.S. PATENT DOCUMENTS

| | | | |
|---|---|---|---|
| 749,337 | 1/1904 | Stewart et al. | 52/703 X |
| 841,036 | 1/1907 | Morse | 52/698 |
| 1,781,889 | 11/1930 | Wertzberger | 52/298 |
| 1,984,211 | 12/1934 | Haase | 52/698 X |
| 2,625,815 | 1/1953 | Black | 52/298 X |
| 2,772,560 | 12/1956 | Neptune | 52/698 X |
| 3,750,349 | 8/1973 | Deike | 52/23 |
| 3,995,833 | 12/1976 | McLaughlin et al. | 256/59 |
| 4,363,467 | 12/1982 | Bos | 256/68 |

FOREIGN PATENT DOCUMENTS

| | | | |
|---|---|---|---|
| 2839574 | 3/1980 | Fed. Rep. of Germany | 52/698 |

*Primary Examiner*—David A. Scherbel
*Assistant Examiner*—Anthony W. Williams
*Attorney, Agent, or Firm*—Foley & Lardner, Schwartz, Jeffery, Schwaab, Mack, Blumenthal & Evans

[57] ABSTRACT

The disclosure herein describes an anchor for mounting a temporary safety fence to the floor of a building under construction; the anchor includes a flat base plate adapted to be secured to the floor, an upright support member having its lower end fixedly secured centrally of the base plate and its upper end shaped to receive the lower end of a correspondingly-shaped fence upright, and a line fastener fixedly secured to the base plate for connecting thereto a safety line used by workers during construction.

8 Claims, 3 Drawing Sheets

Fig. 2
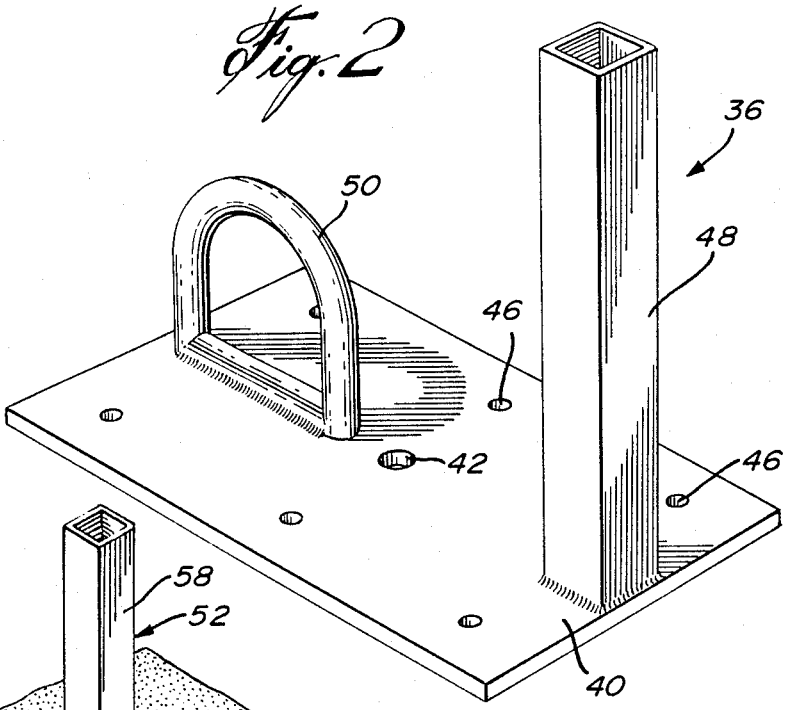
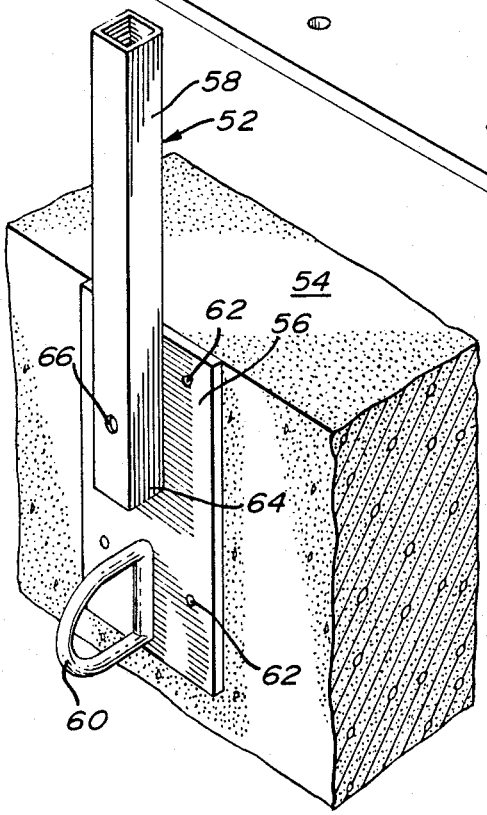
Fig. 3

ANCHOR FOR TEMPORARY SAFETY FENCE

FIELD OF THE INVENTION

The present invention relates to an anchor for mounting a temporary safety fence to the floor of a building under construction.

BACKGROUND OF THE INVENTION

Safety fences or barriers are used in connection with the construction of buildings and are adapted for temporary installation adjacent the outer perimeters of building floors to provide for the personal safety of the workers and also to prevent items lying on the floor from being accidentally displaced over the edges.

Such fences are usually made up of individual sections, each section including longitudinally extending spaced rails which are secured in their spaced relationship by uprights positioned at intervals along each section. These uprights often consist of cylindrical rods which have their lower ends received in cylindrical recesses drilled or otherwise provided in the building floor at predetermined intervals.

Other anchoring systems for these uprights consist of clamps mounted along the edges of the exposed floors.

These fences do not offer adequate anchoring support where extensive force is urged against them as may occur if a worker falls against the interior of the guard rail, leans heavily against it or heavy construction materials are forced against the rails or supports. These safety fences being temporary, it is usually required that they be so constructed that they may be quickly assembled and disassembled.

On most buildings under construction, means must be provided to allow the connection of a safety line or cable attached to the worker so as to permit him to perform his work in all safety. Hence, many hooking connections must be provided at various locations on a floor.

OBJECTS AND STATEMENT OF THE INVENTION

It is an object of the present invention to provide an anchor for a temporary safety fence which overcomes the above described disadvantages of prior fence assemblies.

This is achieved by providing an anchor which comprises: a base plate adapted to be fixedly mounted to the floor of a building under construction; a short vertically-extending upright support member having a lower portion fixedly secured centrally of the base plate and an upper end portion having a shape and dimension to slidably and axially receive a correspondingly-shaped upright forming part of the safety fence; and a line fastener fixedly secured to the base plate for connecting thereto a safety line used by construciton workers during construction.

The present invention is also concerned with the combination of such an anchor described above with a fence upright which is engaged with the support member of the anchor and also with a foot board collar which is mounted to the upright.

The upright is tubular in shape and has a lower end which telescopically engages the support member while the foot board collar consists of a hollow tubular member which, in turn, slidably fits over the upright and of an inverted L-shaped board retainer that has a first end fixedly secured to the hollow tubular member and an opposite free end distantly spaced from the lower end of the tubular member.

Other objects and further scope of applicability of the present invention will become apparent from the detailed description given herein after. It should be understood, however, that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

FIG. 2 is a perspective view showing a first embodiment of an anchor made in accordance with the present invention;

FIG. 3 is a perspective view showing an other embodiment of an anchor made in accordance with the present invention;

DESCRIPTION OF PREFERRED EMBODIMENTS

Figure 1:
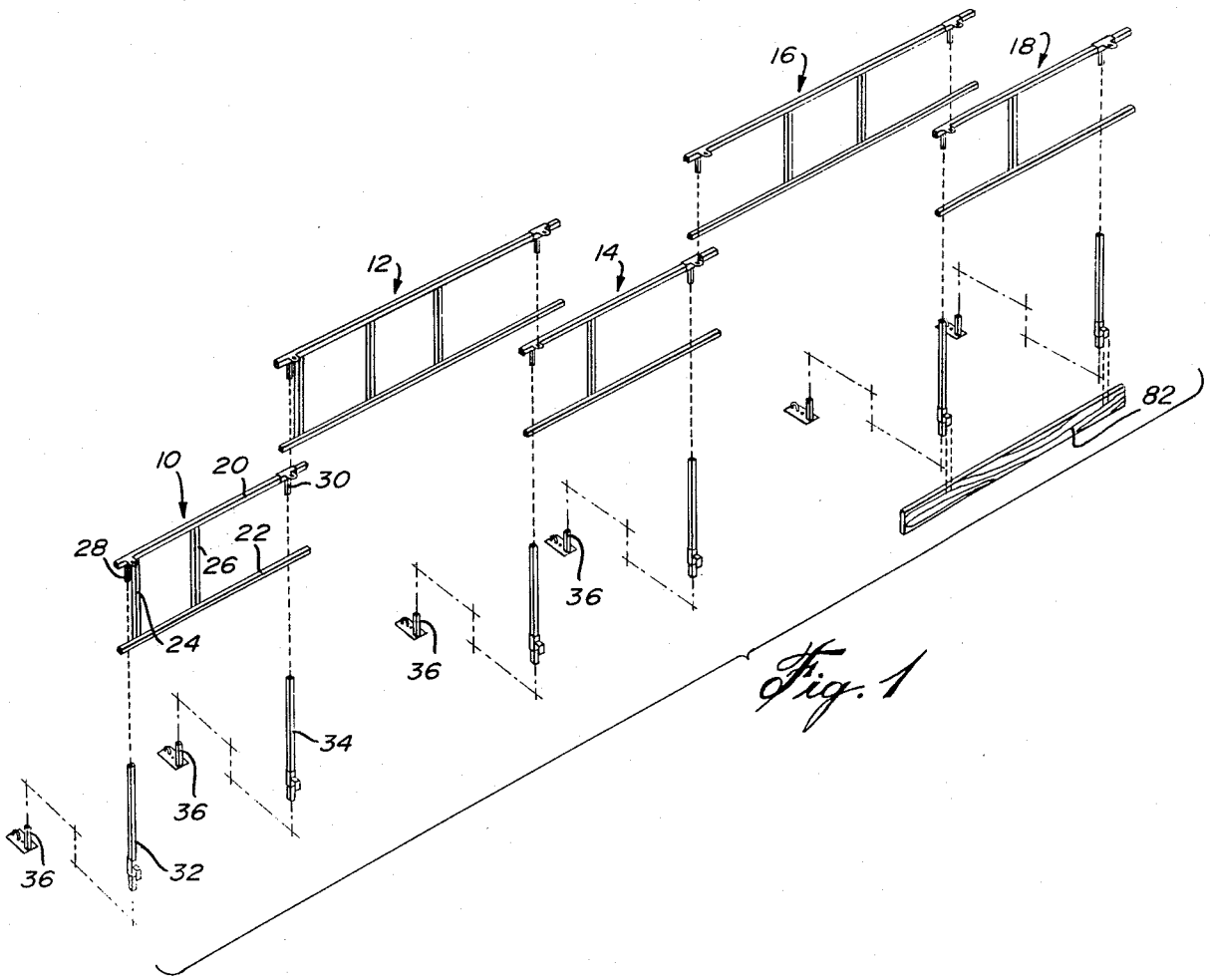
FIG. 1 is an exploded perspective view showing a safety fence assembly incorporating an anchor made in accordance with the present invention.

Referring to FIG. 1, there is shown a series of components which make up the assembly of a safety fence of the type which is temporarily installed adjacent the outer perimeter of a wooden, metallic or concrete floor of a building under construction for the personal safety of the workers.

The fence shown is made up of a series of sections 10, 12, 14, 16 and 18. Each section is formed of horizontally extending upper and lower rails 20 and 22 and of vertically extending members 24 and 26 (see section 10). In the fence illustrated, each section has a fixed hinge 28 and a movable hinge 30, both including vertical pegs which are adapted to be respectively received in the opened upper end of vertical tubular posts 32 and 34. The lower end of these posts is vertically supported in an anchor device 36 made in accordance with the present invention.

Referring to FIG. 2, a first embodiment of an anchor device 36 is shown; it comprises a flat rectangular metallic base plate 40 which is provided with a centrally located hole 42 to receive a fastening bolt 43 (see FIG. 4) whenever the floor 44 to which the anchor device must be secured is concrete. It also includes a series of holes 46 approximately located in the plate to receive nails whenever the anchor device is to be secured to a wooden floor.

Upwardly extending from the top face of the base plate 40, a short tubular support member 48 has an upper end free and a lower end welded to the base plate 40 in the central symmetrical axis thereof.

Opposite to the support member 48 with respect to the center hole 42, a ring 50 is fixed to the base plate. In the present embodiment, the ring has the shape of a D with its straight straight portion longitudinally welded to the top face of the base plate. This ring serves to attach a safety line which is frequently used by workers in buildings under construction.

Referring to FIG. 3, there is shown another embodiment of the present invention; the anchor device 52 shown is mounted to the vertical side wall of the outer perimeter of a floor 54. This anchor device 52 is formed of a base plate 56, a support member 58 and a D-shaped ring 60. The base plate 56 is provided with a series of holes 62 similar to holes 46 of base plate 40 of the embodiment of FIG. 2. The support member 58 lies tangently to the base plate 56 and has a side wall of its lower portion 64 welded to the top face of the base plate 56 while the upper free end extends vertically above the floor 54. The lower portion 64 of the support member 58 has a pair of openings (one of which is shown as 66) on two opposite side walls to allow a fastening bolt to secure the anchor device to the side edge of the floor.- The holes 66 are in registry with one another, but also with a hole (not shown) in the base plate.

Figure 4:
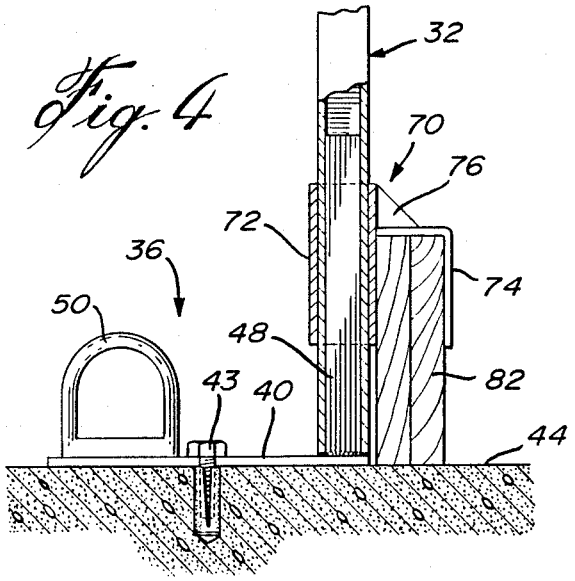
FIG. 4 is an elevation, partly cross-sectional, showing the anchor and the board retainer mounted to an upright of a safety fence.
Figure 5:
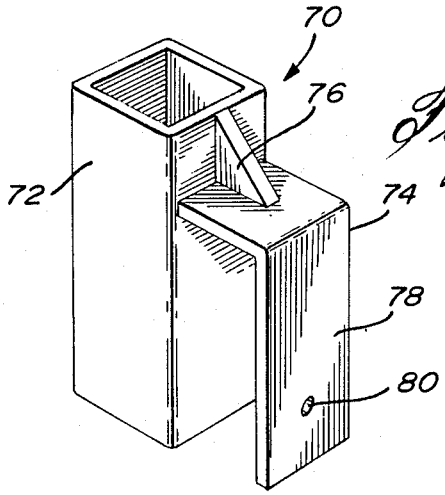
FIG. 5 is a perspective view showing an inverted L-shaped retainer board used in combination with the present invention.

Referring to FIGS. 4 and 5, the anchored base plate 40 is shown fixed to a concrete floor by means of bolt 43. Its support member 48 is received within the fence upright 32 which, in turn, receives thereover a foot board retainer 70 which has a tubular collar 72 and an inverted L-shaped member 74. The latter is reinforcingly secured to the side wall of the tubular collar by means of an angle plate 76. The downwardly extending portion78 of member 74 has a hole 80 which serves to receive a nail for securing one or more foot boards 82 thereto. This board serves to prevent items lying on the floor from being accidentally displaced over the edges.

As it can be noted, once a series of base plates 40 are approximately located on and secured to the floor of a building under construction, the assembly of a safety fence, together with foot boards whenever required, may be quickly mounted in place. Once construction is over, the disassembly of theses fences, as well as of their anchor devices, may also be carried out quickly.

Although the invention has been described above in relation to two specific forms, it will be evident to person skilled in the art that it may be refined and modified in various ways. For example, the line fastener may be used for attaching tarpaulins or sheets which are often used in buildings under construction for protecting workmen from the weather. Also, the location of the lower end of the support member may vary from one anchor to the other. It is therefore wished to have it understood that the present invention should not be limited in interpretation, except by the terms of the following claims.

The embodiments of the invention in which an exclusive property or privilege is claimed are defined as follows:

1. An anchor for mounting a temporary safety fence, including uprights, to a floor of a building under construction, comprising:

a base plate adapted to be fixedly mounted to said floor;

a short vertically-extending upright support member having a lower portion fixedly secured to said base plate and an upper portion shaped to slidably and axially receive thereabout a correspondingly-shaped upright; and a ring having the shape of a D with a straight portion; said straight portion welded to said base plate; said straight portion extending in a central symmetrical axis of said plate; said member extending in said axis; said ring for attaching thereto a safety line used by a worker during construction.

2. An anchor as defined in claim 1, wherein said member extends perpendicular to said base plate; said lower portion of said member having its extremity welded to said base plate.

3. An anchor as defined in claim 1, wherein said base plate includes holes for allowing fastening means to secure said base plate to said floor.

4. An anchor as defined in claim 1, wherein said support member extends tangentially to said base plate; said lower portion of said member having a side wall thereof welded to said base plate.

5. An anchor as defined in claim 3, wherein said base plate includes holes for allowing fastening means to secure said base plate to said floor; said lower poriton of said member having holes in registry with one of said holes in said base plate for allowing fastening means to secure said base plate to said floor.

6. For use with a temporary safety fence to be mounted to a floor of a building under construction, (a) an anchor comprising:

a flat base plate adapted to be fixedly secured to said floor;

a vertically extending tubular support member fixedly secured centrally of said flat base plate; and a ring fixedly secured to said base plate for attaching a safety line thereto allowing a construction worker to be safely attached to said anchor;

(b) a tubular upright having a lower end slidably and axially engaged about said tubular support member of said anchor;

(c) a foot board collar consisting of:

a hollow tubular member slidably and axially received about said upright; and an inverted L-shaped board retainer having one end fixedly secured to said hollow tubular member and an opposite free end spaced from the lower end of said tubular member defining a space to receive a foot board therein.

7. In a temporary safety fence as defined in claim 6, wherein said inverted L-shaped member includes a hole for fastening means to secure said foot board to said member.

8. In a temporary safety fence as defined in claim 6, further comprising reinforcing means connecting of said inverted L-shaped member to said hollow tubular member.

* * * * *